United States Patent [19]

Nigh

[11] 4,098,282

[45] Jul. 4, 1978

[54] CONSTRUCTION ELEMENT CLAMP

[76] Inventor: Billy John Nigh, 4446 Laurel Grove, Studio City, Calif. 91604

[21] Appl. No.: 739,248

[22] Filed: Nov. 5, 1976

[51] Int. Cl.[2] ..... E04F 10/10

[52] U.S. Cl. ..... 135/5 R; 52/5; 135/8; 135/15 CF

[58] Field of Search ..... 256/1, DIG. 4, 59, 65, 256/23; 160/229 B, 60, 61, 62; 135/5 R, 8, 15 CF; 52/74, 75, 78, 83, 665, 489

[56] References Cited

U.S. PATENT DOCUMENTS

| | | | |
|---|---|---|---|
| 852,606 | 5/1907 | Hitch | 52/5 |
| 1,095,484 | 5/1914 | Wright | 52/5 |
| 1,278,559 | 9/1918 | Arnold | 52/5 |
| 1,331,462 | 2/1920 | Sandberg | 135/5 R X |
| 3,381,424 | 5/1968 | Butler | 52/5 |

*Primary Examiner*—Werner H. Schroeder
*Assistant Examiner*—Conrad L. Berman
*Attorney, Agent, or Firm*—Thomas A. Turner, Jr.; Marvin H. Kleinberg

[57] ABSTRACT

A construction element, such as a slat holding clamp is described having tabs and lungs for engaging the slat. The clamp engages the slat on four sides, and includes a tab through which a cable can be run. Certain tabs may optionally include lugs engaging the slat interiorly. The clamp connects the construction element to means for arranging a series of the construction elements in a row to provide a variable shade curtain for an outdoor work area, or to provide slidable curtains.

16 Claims, 6 Drawing Figures

Fig. 1
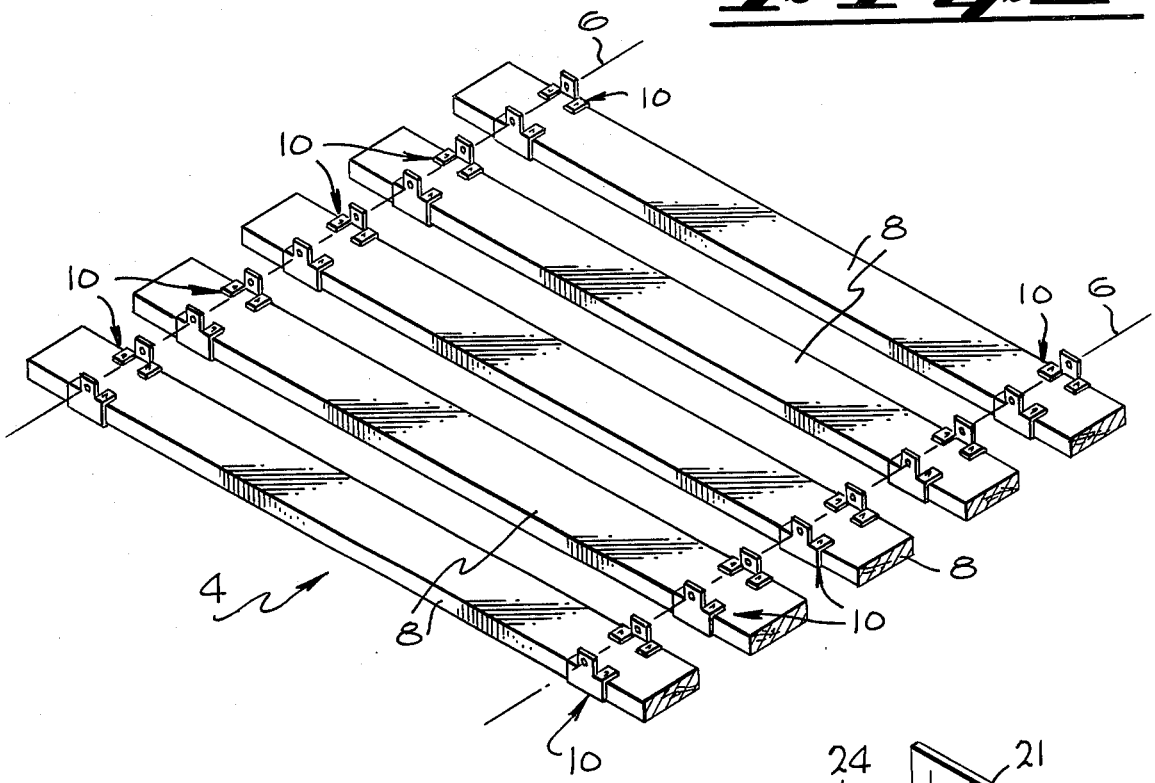
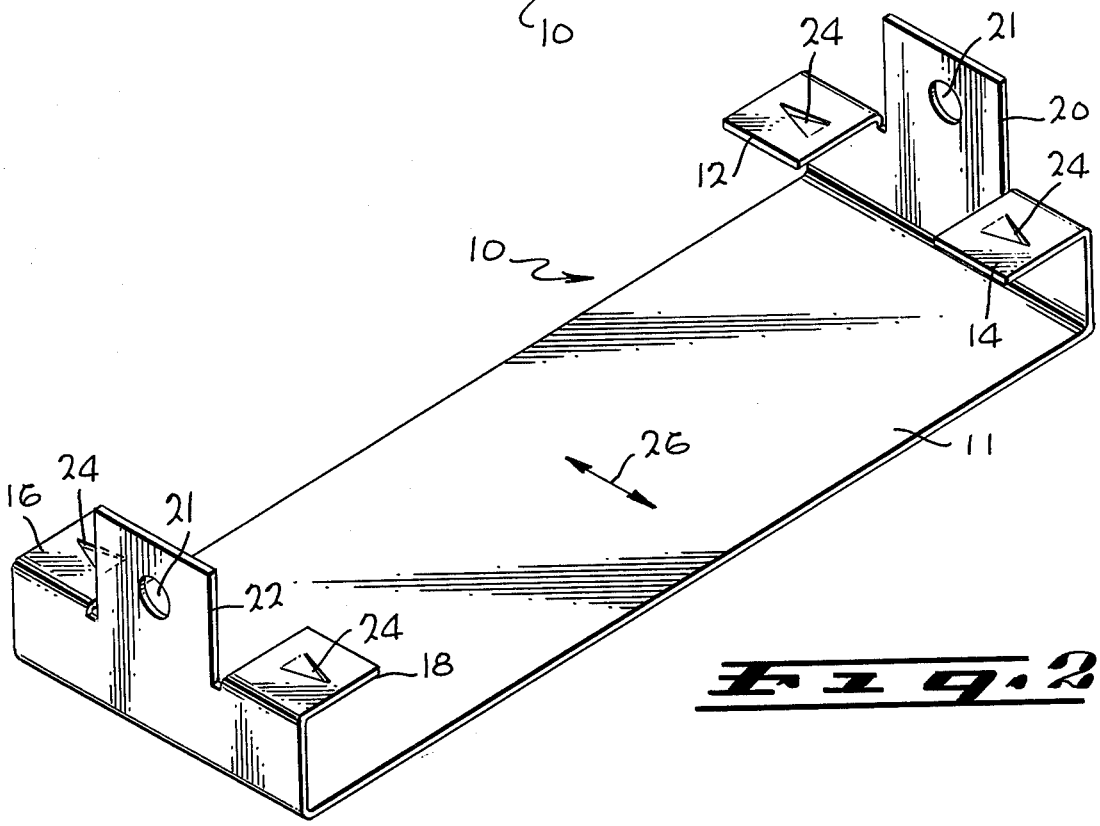
Fig. 2

CONSTRUCTION ELEMENT CLAMP

BACKGROUND OF THE INVENTION

1. Field of the Invention

This invention relates to the construction art, and more particularly to the field of construction element clamps for securing construction elements movably together.

2. Description of the Prior Art

In the past it has often been desired to construct shade and wall-like partitions on patios and in yards. In many situations, it is often desired to have the shading material, such as slats of lumber and the like, easily moved to adjust to different angles of sunlight and, perhaps, to provide some protection from the elements such as rain. In the case of yard partitions, it is often desired to move partitions, again which may be slats of lumber or the like, so as to accommodate for large gatherings or to section off certain areas for smaller gatherings. Frequently, in the past, partitions and shades have been constructed in modular form. When it is desired to rearrange the shade or partition, the entire module is removed or moved to a different location.

It has often been desired to have an easily attached clamp through which cables can be run, for placing slats of lumber adjacent each other and movable relative to each other on the cable. The slats may be horizontally disposed or vertically disposed to act, in the former as a shade, and in the latter circumstance as a partition. It has long been sought, therefore, to obtain an improved clamp arrangement that will secure the clamp onto construction elements such as lumber, which clamp will be economical and efficient in manufacture and simple in construction application.

SUMMARY OF THE INVENTION

In brief, in one form of the invention, it is contemplated that a metal blank having four cuts therein and two holes can be economically mass-produced by automatic manufacturing techniques. The blank will have at least one tab on each of its two oppositely disposed longitudinal edges. The tabs will be creased at two lateral lines so that the tabs can be bent around a slat of lumber or other similarly shaped construction element against which the main portion of the blank will be placed. An additional tab at each of the two oppositely disposed longitudinal edges will be creased for one bend, and to provide parallel holes for threading by a cable. The clamped lumber or similar type construction element can then be slidably moved along the cable relative to adjacently disposed similar construction elements. In an alternative form of this embodiment, lugs can be cut depending from the tabs twice creased, for engagement into the interior of the construction element itself for better securing the clamp to the construction element.

In another form of the invention, a single, generally rectangular blank can be cut having only two cuts from one of its longitudinal end edges, forming two tabs depending therefrom. One tab can be twice creased for folding over a narrow edge of a construction element and for engagement with the main portion of the blank. The main portion of the blank can be twice creased for bending around a slat of lumber to engage opposite faces of the construction element such as lumber. A hole is removed from one portion of one tab. In an alternative embodiment, lugs may be cut depending from a tab for engagement directly with the construction element.

A series of construction elements having these clamps securely fastened thereabout, can be placed side by side, having a cable threaded through the clamp openings. In such a manner, an improved, easily manipulated construction element partition or shade can be constructed easily and quickly by the amateur home builder and carpenter.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

BRIEF DESCRIPTION OF THE DRAWINGS

A better understanding of the present invention may be had from a consideration of the following detailed description, taken in conjunction with the accompanying drawings, in which:

FIG. 1 is a perspective view of one embodiment of the invention showing slats of lumber used as a shade;

FIG. 2 is a perspective view of the clamp of the invention without construction elements shown;

DESCRIPTION OF THE PREFERRED EMBODIMENTS

Figure 3:
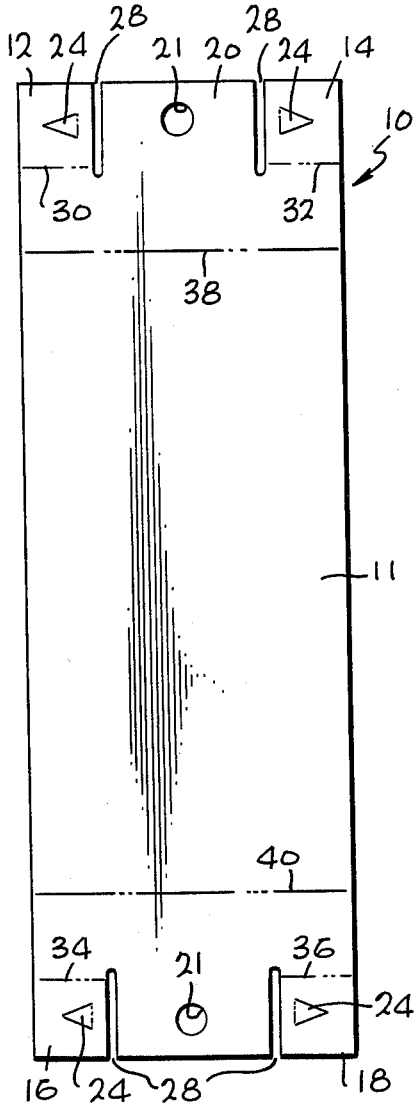
FIG. 3 is a top view of a blank from which the clamp of the invention may be formed.

A shade curtain 4 comprising parallel slats 8 of lumber is shown, reference being had initially to FIG. 1 of the drawings. The slats 8 are suspended from cables 6 by a construction element clamp 10. The cables 6 are threaded through openings 21, seen more clearly in FIGS. 2 and 3 of the drawings.

In FIG. 2, a prospective view of the clamp 10 is seen in more detail. The clamp 10 has a base portion 11 bent at both of its longitudinal end edges. On the right longitudinal end edge, tabs 12 and 14 are bent twice from the base portion 11 so that the interior directed faces of tabs 12, 14 will face and be parallel to the base portion 11. Similarly, at the opposite end edge of the base portion 11, tabs 16, 18 are twice bent so to extend in parallel to the base portion 11. The tabs 12, 14, 16 and 18 are bent to receive the length-wise end edges of a slat, which may be a slat of lumber as shown in FIG. 1, or a slat of any other material, such as medal, plastic, and the like.

On the longitudinal end edge to the right of the base portion 11 in FIG. 2, a tab 20 extends perpendicularly from the base 11. This orthogonal tab 20 has an opening 21 through which the cable 6 may be slidably threaded. Similarly, at the opposite end edge of base 11, tab 22 extends so as to be perpendicular to the base 11. Similarly, the tab 22 has an opening 21 through which the cable 6 may be slidably threaded.

Each of the twice bent tabs 12, 14, 16 and 18 has a lug 24 cut therein. The lugs 24 typically comprise two cuts or slits in the blank of the clamp tab forming an angular intersection having a sharp point. The two slits, which preferably are equal in length, define a lug 24 which may be bent about the broken line as shown into the slat held between the corresponding tab 12, 14, 16 or 18 and the base portion 11. The orientation of the lugs should be arranged so as to interact with the slat being held. Thus, if it is known that the slats 8 are of lumber and have a grain along the direction of the bi-directional arrow 26, the point of the angle of the intersecting slits defining the lugs 24 should be coincidental with the direction of the arrow 26. Thus, it may be appreciated that when the lugs 24 are bent interiorly, they will easily engage the lumber slat 8 along its grain yet securely resist any movement of the clamp 10 relative to the secured slat 8.

It is contemplated as a unique feature of the present invention that the clamp 10 can be easily constructed from a single metal blank as seen more clearly in FIG. 3 of the drawings where for ease in understanding the invention like elements are given identical reference numerals. The blank is cut in a rectangular form, having slits 28 cut from the longitudinal end edges to form the depending tabs 12, 20 and 14 at one longitudinal edge, and tabs 16, 22 and 18 at the opposite longitudinal edge. The holes or openings 21 are cut in the depending tabs 20, 22 for the purpose as given above.

Tab 12 may be creased at crease 30 in order to facilitate the bending of tab 12 so that the portion having the lug 24 can be arranged in parallel to the base portion 11. Similarly, crease 32 can be formed in tab 14, crease 34 can be formed in tab 16, and crease 36 can be formed in tab 18. Crease 38 can be formed in one longitudinal end edge to facilitate its bending into a position perpendicular to the base portion 11. Similarly, crease 40 can be formed at the opposite longitudinal end edge of the base portion 11 to facilitate the perpendicular positioning of tab 22 relative to the base portion 11.

In operation, a blank of material, such as metal, is stamped or otherwise formed in the configuration as seen in FIG. 3 of the drawings. In particular, holes 21 are formed in tab sections 20, 22, and creases 30, 32, 34 and 36 are formed to facilitate the bending of corresponding tabs 12, 14, 16 and 18. Creases 38 and 40 may be formed to facilitate the bending of tabs 20, 22. At one longitudinal end edge, the tabs 12, 20 and 14 are bent first along crease 38. The tabs 12 and 14 are then bent again about creases 30, 32. In a similar manner, at the opposite longitudinal end edge of the blank, tabs 16, 22 and 18 are bent along crease 40. Tabs 16 and 18, further, are bent along creases 34 and 36 to be positioned parallel to the base portion 11. The configuration of FIG. 2 is then achieved.

Slats may then be positioned so as to be embraced between the base portion 11 and tabs 12, 14, 16 and 18. The lugs 24 on each of these parallel tabs is then depressed inwardly to engage, and perhaps to pierce the slats so embraced. Such clamps 10 are then positioned at two locations along each slat 8. The slats 8 are then arranged in parallel having the clamps 10 on each respective slat 8 arranged so that the openings 21 are in alignment with those of corresponding clamps on adjacent, parallel slats 8. Cables 6 are then threaded through the openings 21 on the clamps 10. The cables 6 are then suspended so that the slats 8 can provide a ceiling shade curtain as desired. The slats 8 may then be slid along the cable 6 by virtue of the clamp suspension arrangement so that the shade provided can be changed according to desire.

Figure 4:
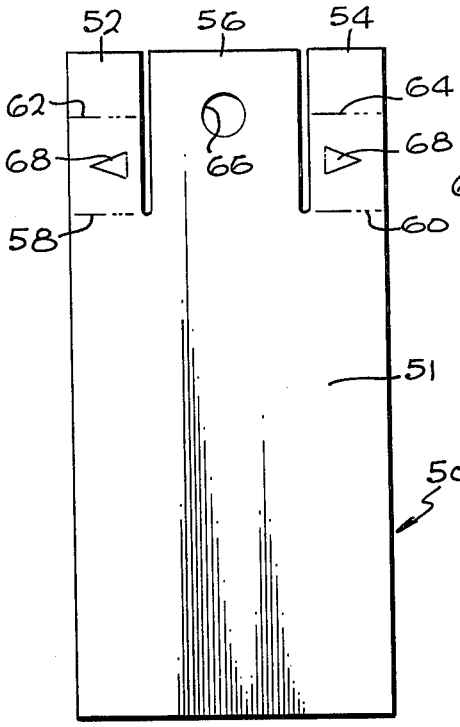
FIG. 4 is a side elevational view of an alternative embodiment of the clamp of the invention.
Figure 5:
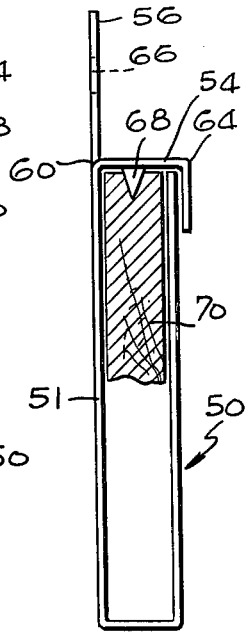
FIG. 5 is a side elevational view of the clamp embodiment of FIG. 4 shown bent into use and engaging a construction element.

In an alternative embodiment, seen more clearly in FIGS. 4 and 5 of the drawings, a clamp 50 is shown having tabs 52, 54 and 56 depending from one longitudinal end edge of a blank 51. Tabs 52 and 54 are creased for bending about creases 58, 60, 62 and 64. An opening 66 for slidably receiving a cable is formed in tabs 56.

The opposite longitudinal edge of the blank 51 is creased for two bends so that one end of the blank 51 is positioned parallel to the opposite portion of the blank 51. Lugs 68 are defined by two intersecting slits on each of the tabs 52, 54 as shown. The lugs 68 are arranged so that they may be bent along the broken lines shown in FIG. 4.

A slat, such as slat 70 of lumber shown partially in FIG. 5 of the drawings, can be positioned between the two parallel portions of the blank 51. The tabs 52, 54 are then bent along first corresponding creases 58, 60 and then along corresponding creases 62, 64 so as to engage the complete periphery of slat 70. The tab 56 is not bent, but extends directly from one portion of the blank 51. The lugs 68 are then bent to engage interiorly the slat 70, as shown.

Figure 6:
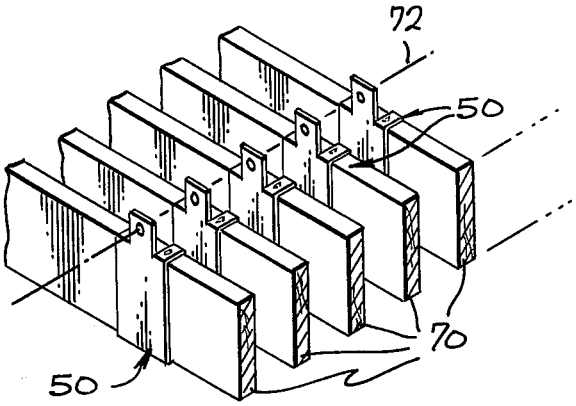
FIG. 6 is a perspective view of the clamp invention of the alternative embodiment in use with constructional elements.

In operation, the clamps 50 can be positioned at two locations along a slat 70. A plurality of so constructed slats can be arranged so that the respective openings 66 of the clamps 50 of each slat 70 are in alignment with openings 66 of adjacent parallel slat clamps as seen in FIG. 6 of the drawings. A cable 72 can then be threaded through the openings 66 of the aligned clamps 50. The cable 72 can then be suspended to position the so defined curtain 74 of slats 70 as may be desired. The individual slats 70 of the curtain 74 can be slidably moved along the cables 72 to achieve the effective shading or partitioning effect of the curtain according to desires.

Thus, there have been shown improved slat engaging clamps for easily and slidably arranging slats to form a curtain or a ceiling shade in accordance with two aspects of the invention. It may be appreciated by those skilled in the art that variations of the clamps and curtains as shown may be devised without departing from the spirit of the present invention. For representative example, the slats so clamped may be used to form a suspended floor or the like. Further, bolts or other fastening elements may be employed in lieu of the described lugs. Other variations may be appreciated. Accordingly, the present invention should be limited only by the appended claims.

I claim:

1. A clamp for securing an elongate element to a cable, comprising a rectangular blank having two oppositely disposed end edges including:

a first tab means depending from a first of said end edges and a second tab means depending from the oppositely disposed, second of said end edges, said first tab means and said second tab means each for securing the elongate element against the blank, at least said first tab means including at least a first tab depending from one end edge of the blank;

a third tab means adapted for moveable connection to a cable, the third tab means including a third tab depending from an end edge of the blank.

2. The clamp of claim 1 further including a fourth tab means adapted for moveable connection to the cable, the fourth tab means including a fourth tab depending from the oppositely disposed, second end edge of the blank.

3. The clamp of claim 2 wherein the first tab means further includes a second tab depending from its corresponding end edge of the blank, and wherein the second tab means further includes a first tab and a second tab depending from its corresponding end edge of the blank and adapted to secure the element against the blank.

4. The clamp of claim 2 wheren the first tab depending from one end edge of the blank includes a lug.

5. The clamp of claim 4 wherein the element is a slat of wood.

6. The clamp of claim 5 wherein said lug is aligned with the grain of the wood and adapted to be inserted into the wood.

7. A curtain of construction elements slidably hung comprising:

a plurality of adjacently disposed construction elements;

cable means including at least one cable for hanging the said construction elements; and a plurality of clamping means, at least one corresponding to each of said construction elements for slidably connecting individual corresponding ones of said construction elements to said cable means, each said clamping means including a bendable blank having at least one first kind of tab depending from at least one of oppositely disposed first and second end edges of the blank and adapted to secure the clamp to an individual, corresponding one of the construction elements, and at least one second kind of tab depending from one of said end edges and adpated to slidably connect to the cable means.

8. The curtain of claim 7 wherein said blank has at least one said first kind of tab depending from each of said oppositely disposed end edges.

9. The curtain of claim 8 wherein said blank has two said first kind of tabs depending from each of said oppositely disposed end edges.

10. The curtain of claim 7 wherein said blank has one said second kind of tab depending from each of said oppositely disposed end edges.

11. The curtain of claim 10 wherein each said second kind of tab has a hole therethrough adapted to receive the cable.

12. The curtain of claim 7 wherein each said first kind of tab includes a lug depending from the tab.

13. The curtain of claim 12 wherein the lug includes a bend and a point in alignment with the material of the corresponding construction element.

14. The curtain of claim 13 wherein the construction elements are slats of wood.

15. The curtain of claim 7 wherein each of the construction elements is a slat, and each said blank is bendable to engage opposite faces of the slats.

16. The curtain of claim 15 wherein the first kind of tab overlaps the blank end edge opposite from which the said first kind of tab depends.

* * * * *